United States Patent [19]

Collett et al.

[11] Patent Number: 4,553,490

[45] Date of Patent: Nov. 19, 1985

[54] LOCKSTITCH SEWING MACHINE

[75] Inventors: Geoffrey K. Collett, Glenfield; Christopher B. Martin-Jones, Birstall; Peter N. Tapner, Twickenham; David J. Commander, Milton Keynes; Mark S. Gilbey, Edgware; Robert S. Berks, Milton Keynes, all of England

[73] Assignee: USM Corporation, Farmington, Conn.

[21] Appl. No.: 648,658

[22] Filed: Sep. 7, 1984

[30] Foreign Application Priority Data

Sep. 8, 1983 [GB] United Kingdom ..... 8324064

[51] Int. Cl.[4] ..... D05B 15/02

[52] U.S. Cl. ..... 112/38; 112/58; 112/243; 112/239; 112/274

[58] Field of Search ..... 112/38, 37, 54, 57, 112/58, 59, 181, 185, 241, 242, 243, 274, 239

[56] References Cited

U.S. PATENT DOCUMENTS 658,604 9/1900 Warren ..... 112/58
684,540 10/1901 Chadbourn ..... 112/58
957,954 5/1910 Heys ..... 112/58
2,928,361 3/1960 Ashworth et al. ..... 112/274 X

FOREIGN PATENT DOCUMENTS 410463 5/1934 United Kingdom ..... 112/38

*Primary Examiner*—H. Hampton Hunter
*Attorney, Agent, or Firm*—Donald N. Halgren

[57] ABSTRACT

A lockstitch sewing machine has, in addition to stitch forming instrumentalities (22, 24), a needle thread control arrangement (32) by which the tension in the needle thread (T2) is controlled during stitch formation. In addition, said arrangement (32) ensures that each formed stitch is drawn into the body of the workpiece, by pulling on the thread while it remains clamped by thread clamping means (200, 202). This pulling takes place in the early stages of the formation of the next stitch so that, at the end of the machine stitching cycle, the final stitch is not set by this arrangement (32). Instead, electrically actuated stitch setting means (220 to 226) is provided operable in response to an "end of cycle" signal supplied by control means by which further "end of cycle" functions (e.g. release of a presser foot (36) and of the thread clamping means (200, 202) are also controlled.

9 Claims, 8 Drawing Figures

LOCKSTITCH SEWING MACHINE

BACKGROUND OF THE INVENTION (1) Field of the Invention

This invention is concerned with lockstitch sewing means, especially, but not exclusively, lockstitch sewing machines for use in the shoe industry where, for example, outsoles of thick, tough material, e.g. leather, are stitched to welts in the production of welted shoes.

(2) Prior Art

There is described in UK Patent Specification No. 410463 a lockstitch sewing machine comprising stitch forming instrumentalities, including a reciprocating hooked needle, on to the hook of which a loop of (needle) thread can be looped, when the needle has penetrated a workpiece and while it is projecting therethrough, and also a rotatable shuttle, by which the loop of thread is engaged, after retraction of the needle, and a lockstitch is formed using said loop and a further (bobbin) thread, thread measuring means for supplying a measured quantity of needle thread for each stitch formation, means, arranged "upstream" of the stitch forming instrumentalities, for clamping the thread after the measured quantity has been supplied as aforesaid, and means, arranged between the thread clamping means and the stitch forming instrumentalities, and including a thread take-up arrangement, by which said measured quantity of thread is controlled during stitch formation and by which also a formed lockstitch can be drawn into the body of the workpiece, such drawing of the formed stitch taking place while the thread remains clamped by the thread clamping means, but after the start of the formation of the next following stitch.

It will be appreciated that, at the end of a machine stitching cycle (i.e. at the end of a series of stitches), the workpiece can be removed from the operating locality only if the stitch forming instrumentalities are out of penetrating engagement therewith. However, bearing in mind that the setting of each stitch takes place only after the start of the formation of the next following stitch, the problem arises that the final stitch formed in a machine stitching cycle cannot be properly set. Instead, it is usually left to the operator to pull on the needle thread, thereby drawing the formed lockstitch into the body of the workpiece. In some machines, e.g. the machine described in the aforementioned patent specification, the stitch is almost set at the end of a stitch forming cycle, but in other machines the situation may arise where the stitch is not set until well after the start of the next stitch formation. In any event, relying on the operator to set the final stitch is generally unreliable since not only can the operator overlook to do so, but further the distance by which the formed stitch is drawn into the body of the work cannot be reliably controlled.

It is thus the object of the present invention to provide an improved lockstitch sewing machine in which the setting of the final stitch formed in a machine stitching cycle can be reliably and accurately controlled.

BRIEF SUMMARY OF THE INVENTION

The invention thus provides a lockstitch sewing machine comprising stitch forming instrumentalities, including a reciprocating hooked needle, on to the hook of which a loop of (needle) thread can be looped, when the needle has penetrated a workpiece and while it is projecting therethrough, and also a rotatable shuttle, by which the loop of thread is engaged, after retraction of the needle, and a lockstitch is formed using said loop and a further (bobbin) thread, thread measuring means for supplying a measured quantity of needle thread for each stitch formation, means, arranged "upstream" of the stitch forming instrumentalities, for clamping the thread after the measured quantity has been supplied as aforesaid, and means, arranged between the thread clamping means and the stitch forming instrumentalities, and including a thread take-up arrangement, by which said measured quantity of thread is controlled during stitch formation and by which also a formed lockstitch can be drawn into the body of the workpiece, such drawing of the formed stitch taking place while the thread remains clamped by the thread clamping means, but after the start of the formation of the next following stitch, wherein, for the final stitch formed in a machine stitching cycle, stitch setting means is provided which is arranged "downstream" of the thread clamping means and which, in response to an "end of cycle" signal, is caused to pull on the thread to draw the formed stitch into the body of the workpiece prior to the release of the thread by the thread clamping means, the latter thereafter being operated to release the thread.

It will thus be appreciated that, using the machine in accordance with the invention, the final stitch formed in a machine stitching cycle can now be reliably and accurately set without the intervention of the operator.

Conveniently, a timer is provided which is actuated when the stitch setting means is operated and, on timing out, causes the thread clamping means to be operated to release the thread. The timer is of course set so as to allow sufficient time for the stitch setting operation to be completed.

The machine in accordance with the invention preferably comprises electrically operated control means for controlling the stitch setting means and other "end of cycle" functions, as will be referred to hereinafter. Where the machine is so provided, furthermore, conveniently the stitch setting means is operated by an electrically operated motor, e.g. a solenoid.

In the machine described in the aforementioned patent specification, a worktable and a presser foot are arranged at an operating locality of the machine for clamping therebetween a workpiece to be stitched and for feeding such workpiece step-by-step past the stitch forming instrumentalities. At the end of a cycle of operation of the machine, the presser foot is raised in order to enable the operator to remove the finished workpiece from the machine, this being achieved by a mechanical arrangement upon the release of a treadle by the operator. In the machine in accordance with the present invention, on the other hand, conveniently the presser foot is moved out of such clamping engagement, in response to the "end of cycle" signal, under the control of a electrically operated linear motor, the arrangement being such that said motor is caused to operate to move the presser foot after the stitch setting means has been operated as aforesaid. Furthermore, where a timer is provided as aforesaid for initiating release of the thread clamping means, conveniently also the linear motor is operated as aforesaid on timing out of the timer and serves also to cause the thread clamping means to be operated to release the thread. To this end, furthermore, conveniently the linear motor is connected to the presser foot through a linkage arrangement and is directly connected to the thread clamping means through a Bowden cable arrangement.

In one embodiment of the present invention, the operation of the stitch forming instrumentalities is controlled by a shaft which is driven by a braked motor and on which also is carried a shaft encoder, the arrangement being such that, in response to the "end of cycle" signal, the motor is braked to a slow speed whereafter it continues rotating until a "stop" position, in which the stitch forming instrumentalities are clear of the workpiece, is sensed by the encoder, whereupon the brake is re-applied to stop the rotation thereof, the encoder also signalling the operation of the stitch setting means to take place as aforesaid, when such stop position is sensed. In this way the control of the various "end of cycle" functions can be simply but reliably achieved, thereby dispensing with the relatively complex mechanisms of the machine described in the aforementioned patent specification.

As in the machine described in the aforementioned specification, in the machine in accordance with the present invention also preferably, in addition to the thread clamping means referred to above, further thread clamping means is also provided, arranged "downstream" of the thread measuring means, the arrangement being such that said further means is operated to clamp the needle thread while a measured quantity is drawn from a supply thereof by the thread measuring means. In addition, the first-mentioned thread clamping means is arranged "upstream" of the further thread clamping means and serves to clamp the thread after the thread measuring means has operated as aforesaid. In the machine in accordance with the present invention, furthermore, conveniently the stitch setting means is disposed intermediate the two thread clamping means and is operated while the first-mentioned means is in thread clamping condition, but while the thread is unclamped by said further means. In this way, the stitch setting means is formed relatively compact and can be incorporated in the general thread supply arrangement of machines of the type described in the aforementioned patent specification without the need for any significant modification to such thread supply arrangements.

BRIEF DESCRIPTION OF THE DRAWINGS

There now follows a detailed description, to be read with reference to the accompanying drawings, of one machine in accordance with the invention, which machine has been selected for description merely by way of exemplification of the invention and not by way of limitation thereof.

In the accompanying drawings.

DESCRIPTION OF THE PREFERRED EMBODIMENT

Figure 5:
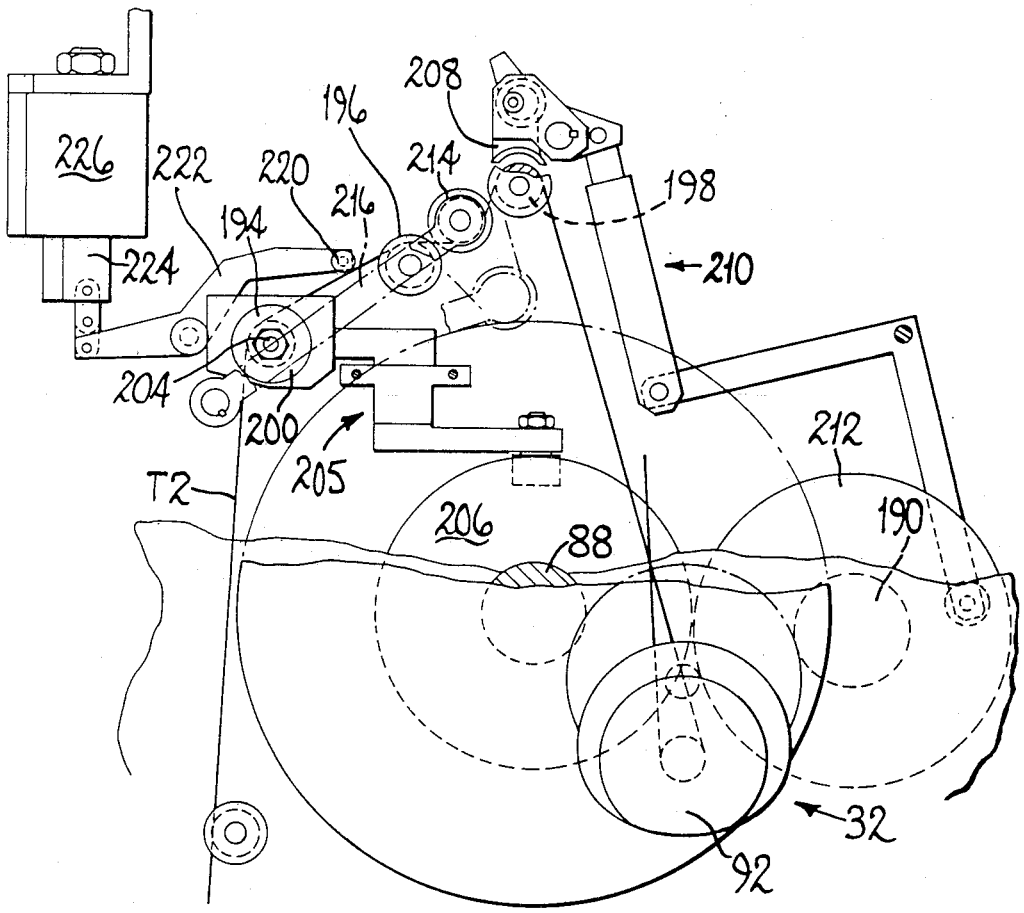
FIG. 5 is a fragmentary front view of the machine, showing details of various integers controlling the supply of running thread, including stitch setting means.

The machine in accordance with the present invention is generally similar, except as hereinafter described, to the machine described in UK Patent Specification No. 410463 and is for use in sewing outsoles of welted shoes to the welts of such shoes by a lockstitch seam. The machine thus comprises stitch forming instrumentalities comprising a curved needle 20, a needle guide 22 and an awl 24. For feeding the two threads T1, T2 required for lockstitch formation, a shuttle arrangement generally designated 26 is provided for the bobbin thread T1, and a feed arrangement for the so-called needle or running thread T2 is provided, this latter arrangement comprising thread measuring means generally designated 28 (FIG. 5), a so-called looper 30 and a thread take-up arrangement generally designated 32.

For ensuring that the running thread is reliably engaged by the needle, for drawing through the work, furthermore a so-called thread hook (not shown) is provided, and similarly, for ensuring that the shuttle arrangement 26 takes up the running thread T2, after it has been drawn through the work, a so-called thread lifter (also not shown) is provided. The work, which is constituted by a welt secured to a shoe bottom, together with an outsole to be stitched to said welt, is clamped between a so-called worktable 34 and a presser foot 36, the arrangement being such that the worktable and presser foot are movable together, laterally of the machine, while in clamping engagement with the work to feed the work appropriately, while they are also movable in a return direction, while out of such clamping engagement, during the time when the awl 24 is in penetrating engagement with the work, the worktable 34 being provided with a suitable awl-receiving slot for this purpose. The amount of such lateral movement is adjustable by appropriate adjusting means (not shown). The adjusting means is described in detail in the above-identified UK Patent Specification, while the construction of the shuttle arrangement 26 is described in detail in UK Patent Specification No. 806265. In the operation of the machine, with a workpiece held clamped between the worktable 34 and presser foot 36, firstly the awl 24 is actuated so as to pierce the work, thereby providing an appropriate passage for the needle 20 which is caused to follow the awl into penetrating engagement with the work, as the awl is retracted, the needle guide 22 moving together with the needle over the first part of its movement in order to support the leading end of the needle as it is brought into initial engagement with the work.

Figure 3:
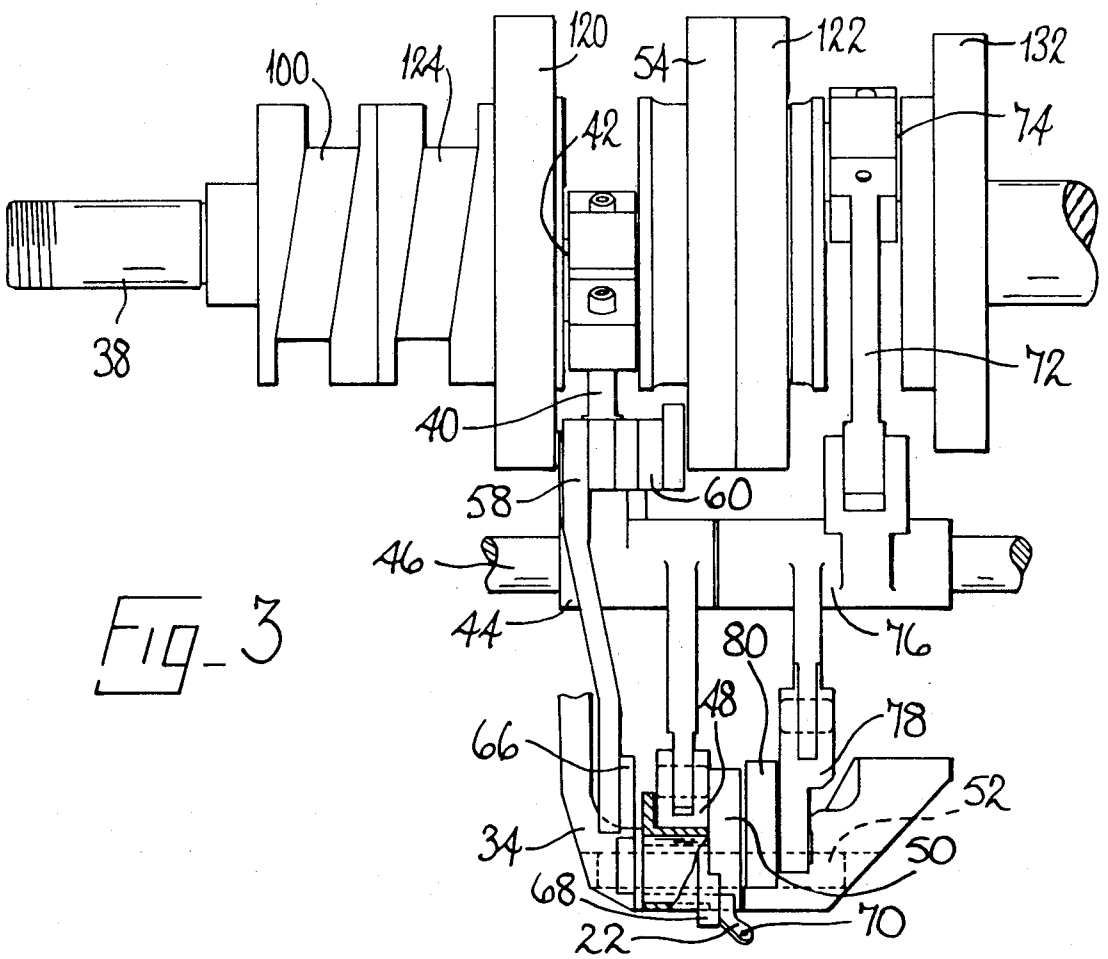
FIG. 3 is a fragmentary view in plan, showing details of a main crank shaft of the machine.
Figure 4A:
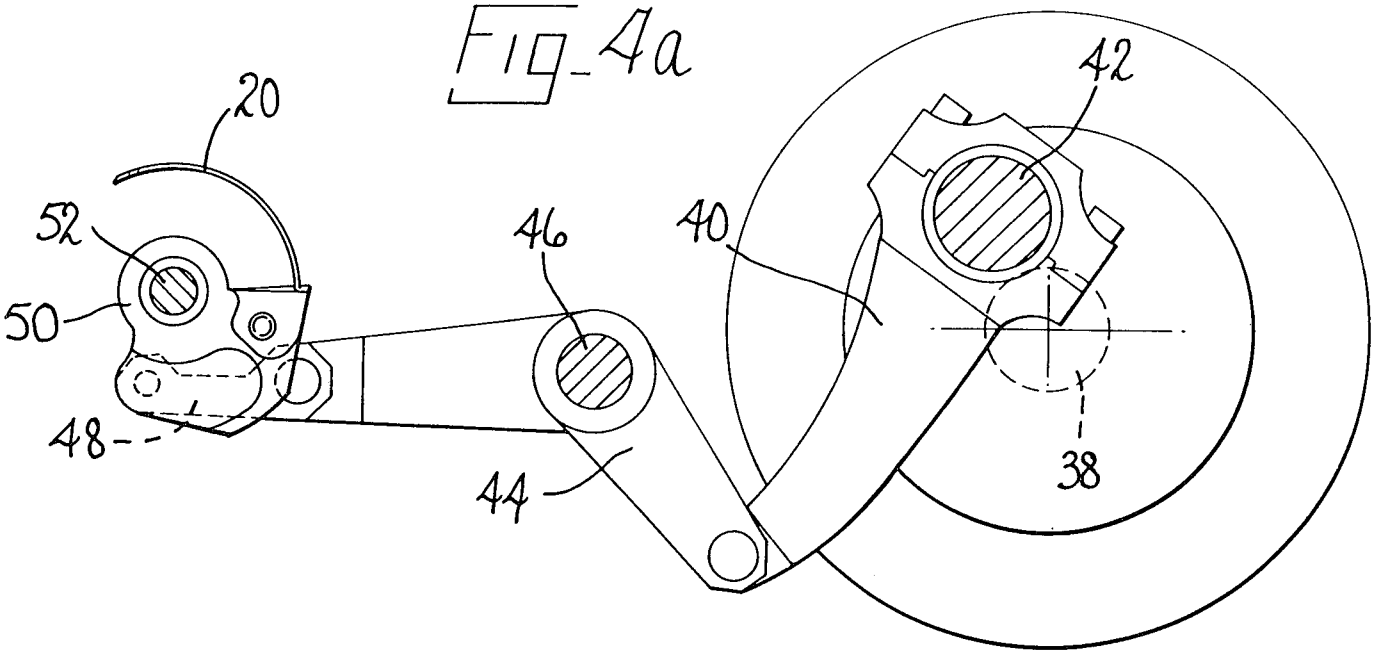
FIGS. 4*a*, 4*b* and 4*c* are detailed views of mechanisms for operating respectively a needle, needle guide and awl of the machine.

In the machine in accordance with the present invention, for actuating the needle 20 and the awl 24 crank mechanisms are provided, and for actuating the needle guide 22 a cam arrangement is provided, mounted on a horizontal laterally extending crank shaft 38, as will now be described with reference to FIG. 3. For actuating the needle 20 (see also FIG. 4*a*) a crank arm 40 is clamped to a pivot pin 42 carried eccentrically on the crank shaft 38, the opposite end of the arm 40 being pivotally connected to one arm of a bell crank lever 44 supported for pivotal movement on a cross-shaft 46 which is carried in the machine frame. The other arm of the bell crank lever 44 is connected to a bifurcated end of a link 48, a remote end of which is in turn pivotally connected to a carrier 50 on which the curve needle 20 is mounted. The carrier 50 is pivotal about a further cross-shaft 52, the axis of which is coincident with the centre of curvature of the curved needle 20.

Figure 4B:
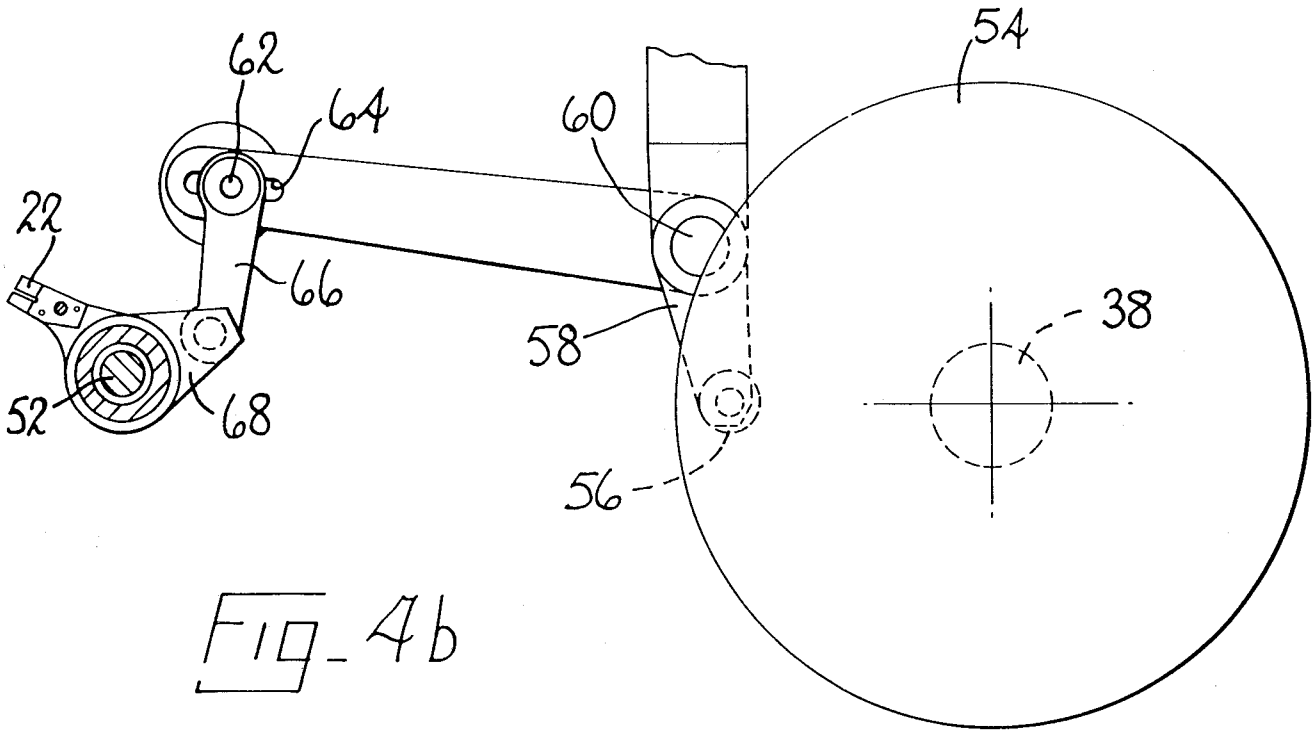

For actuating the needle guide 22 (see also FIG. 4*b*) a cam 54 is mounted on the crank shaft 38, having an enclosed cam path (not shown)in which is captive a cam follower 56 carried by a bell crank lever 58 mounted for pivotal movement on a stub shaft 60 supported by the machine frame. The other arm of the bell crank lever is connected, by a pin (62) and slot (64) connection, to a link 66 which is pivotally connected to a carrier 68 for the needle guide 22. The carrier 68 is mounted for rotation on the cross shaft 52. The needle guide 22 has an aperture 70 therein to allow the passage therethrough of the needle 20, the passage 70 being spaced from the axis of the cross-shaft 52 by the same distance as the distance of the needle point from said axis.

The needle guide 22 can be rotated about the shaft 52 through an angle of 120°, from an out-of-the-way position to proximity to the work clamped by the presser foot 36 and worktable 34, while the needle can be rotated through an angle of some 254°.

Figure 4C:
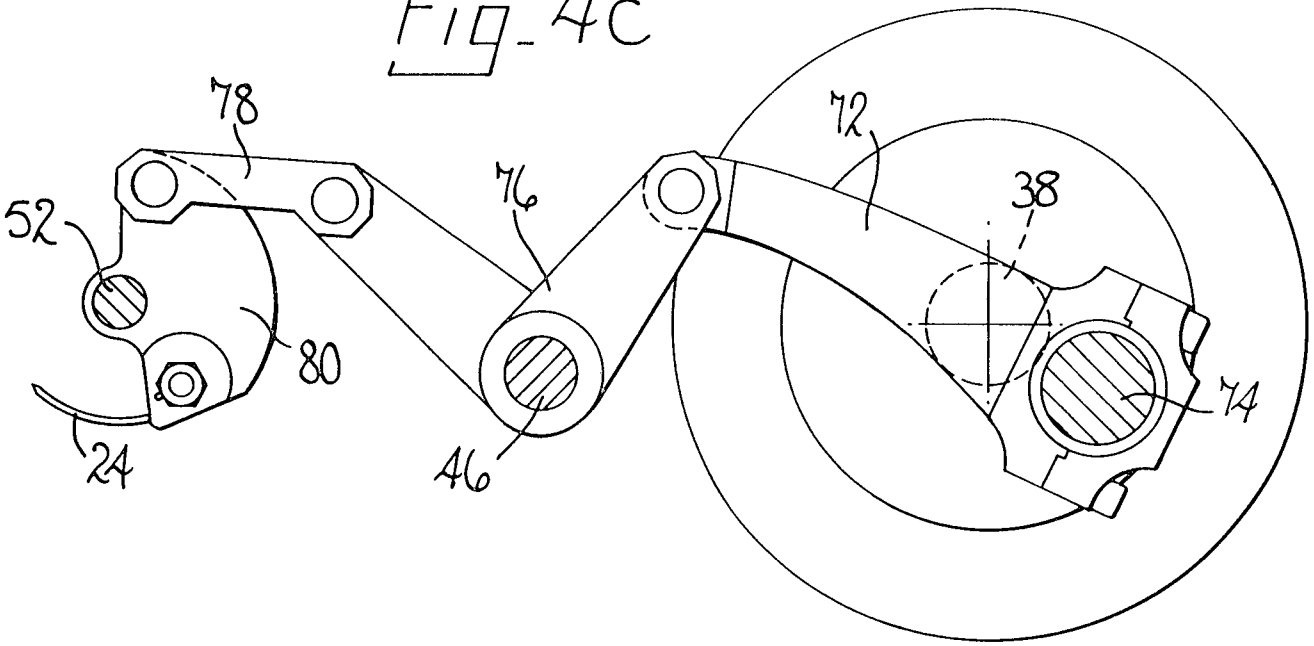

For actuating the awl 24 (see also FIG. 4*c*), a further crank arm 72 is supported by a pivot pin 74 carried eccentrically on the crank shaft 38, the crank arm 72 being connected to a bell crank lever 76 which is mounted for pivotal movement on the cross-shaft 46. The other arm of the bell crank lever 76 is pivotally connected to one end of a link 78 the other end of which is pivotally connected to a carrier 80 for the awl 24. Again, the carrier 80 is supported by the cross-shaft 52, and the distance by which the leading end of the awl 24 is spaced from the axis of said cross-shaft is the same as the distance by which the leading end of the needle 20 is spaced therefrom. It will of course be appreciated that the carriers 50, 80 are arranged to support respectively the needle 20 and the awl 24 in the same vertical plane. Also, as can be seen from FIG. 3, the two crank mechanisms for the needle 20 and awl 24 are disposed closely adjacent said common vertical plane.

For driving the crank shaft 38, a pulley-and-belt arrangement (not shown) is provided, which is operatively connected to the crank shaft 38 through a clutch arrangement (not shown) and which is driven by a main drive motor (also not shown) mounted on the machine frame. The pulley-and-belt arrangement includes a pulley 82 which is carried at one end of a drive shaft (not shown) on which is carried a bevel gear 84 (see FIG. 1) meshing with a further bevel gear 86 which is carried on a shaft 88 extending fore-and-aft of the machine. At the forward end of the shaft 88 is carried a disc 90 which forms part of the thread take-up arrangement 32, and which supports a thread take-up roll 92. The operation of the thread take-up arrangement is generally as described in UK Patent Specification No. 410463. Furthermore, the gearing of the pulley-and-belt arrangement is such that the speed of rotation of the crank shaft and that of the shaft 88 are the same, so that the disc 90 of the thread take-up arrangment 32 effects on rotation for each stitch forming operation of the needle 20 and awl 24.

Figure 1:
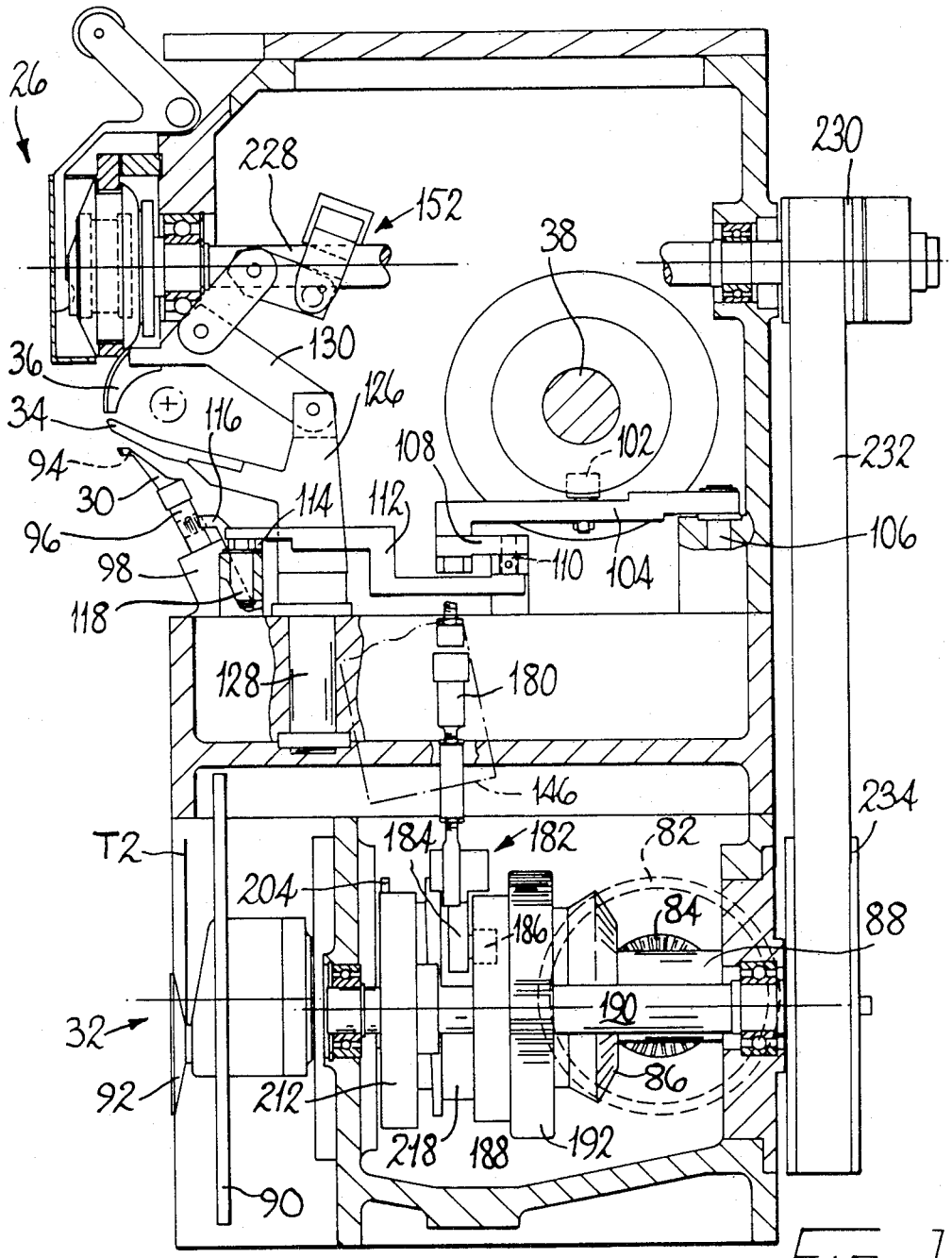
FIG. 1 a right hand side view, partly in section and with parts broken away, of the machine in accordance with the invention, showing details of a worktable and presser foot of the machine and indicating the general layout of the machine.

The looper 30 is arranged between the take-up arrangement 32 and the worktable 34 and comprises a tubular thread guiding passage 94 through which the running thread T2 passes. As described in detail in UK Patent Specification No. 410463, the looper 30, in combination with the thread hook (not shown), serves to ensure engagement of the hook of the needle 20 with a loop of running thread T2 formed therebetween, after the needle 20 has penetrated through the work and is projecting downwardly therebeneath. To this end, the looper is arranged to move transversely of the operating locality of the machine to form the loop and to carry the running thread T2, which is held by the thread hook at one side of the projecting needle 20, over the hook of said needle. For effecting such transverse movement of the looper, the looper is carried on a stem 96 which is mounted for rotational movement about its longitudinal axis, in a bearing 98 forming part of the machine frame. The axis of the stem 96 is inclined at some 25° to the vertical, and furthermore the looper 30 is cut away (as shown in FIG. 1), whereby, as the looper effects its transverse movement, it remains clear of the projecting needle. For rotating the stem 96, and thus the looper 30, in timed relation with the other operating instrumentalities of the machine, a barrel cam 100 is provided on the crank shaft 38, a cam follower 102 for said cam being mounted on a lever 104 intermediate its length, the lever 104 being carried by a pivot pin 106 supported in the machine frame. The other end of the level 106 is pivotally connected to a link 108 which is itself secured to a pivot pin 110 mounted also in the machine frame. Also secured to the pivot pin 110 is a crank lever 112, a forward end of which is connected by a link 114 to a toothed segment 116 which is mounted for rotation about a pivot pin 118 also secured in the machine frame. The teeth of the toothed segment 116 mesh with teeth provided on the stem 96 of the looper. In this way, rotation of the crank shaft, and thus of the barrel cam 100 is effective, through the intermeshing teeth to cause the looper to rotate about the axis of the stem 96. The barrel cam 100 is so constructed that the looper effects a thread-transferring motion in one direction and is then returned to its initial position, once in each stitch forming operation of the machine, the thread-transferring movement being timed to take place while the needle projects downwardly from the work.

For controlling the operation of the thread hook a further cam 120 is mounted on the crank shaft 38. In this way, the thread hook is caused to operate in timed relation with the looper. The mechanism and the mode of operation of the thread hook is generally as described in detail in UK Patent Specification No. 410463.

After the thread has engaged over the hook of the needle 20, the needle is then withdrawn upwardly through the work, so that a loop of the running thread T2 is located above the work. In this position, as described in detail in the UK Patent Specification No. 410463, the so-called thread-lifter (not shown) engages in the loop and, in combination with the needle, forms the loop into a triangular shape through which a beak (not shown), forming part of the shuttle arrangement 26, can pass, taking the thread from the hook of the needle 20 and forming the lockstitch therein, as the shuttle arrangement 26 rotates. The movement of the thread lifter, which is controlled by a further cam 122 on the crank shaft 38, is again generally as described in the aforementioned patent specification, and the construction of the thread lifter mechanism is generally there described (except of course that the crank shaft 38 is horizontal, whereas the corresponding shaft in the earlier machine is vertically disposed).

Also mounted on the crank shaft 38 is a barrel cam 124 by means of which, through a linkage (note shown), the worktable 34, mounted on a bracket 126, is caused to pivot about a vertical axis provided by a pin 128 mounted in the machine frame. Also supported by the bracket 126, is a bifurcated upper end thereof, is a lever 130 supporting the presser foot 36, so that the presser foot moves together with the worktable 34 about the axis of the pin 128. The general operation of the presser foot 36 and worktable 34 is as described in the aforementioned Patent Specification No. 410463, a suitable mechanism (now shown) being provided for varying the throw of the two components, and thus for varying the feed length for the workpiece, generally in the manner described in said specification.

Figure 2:
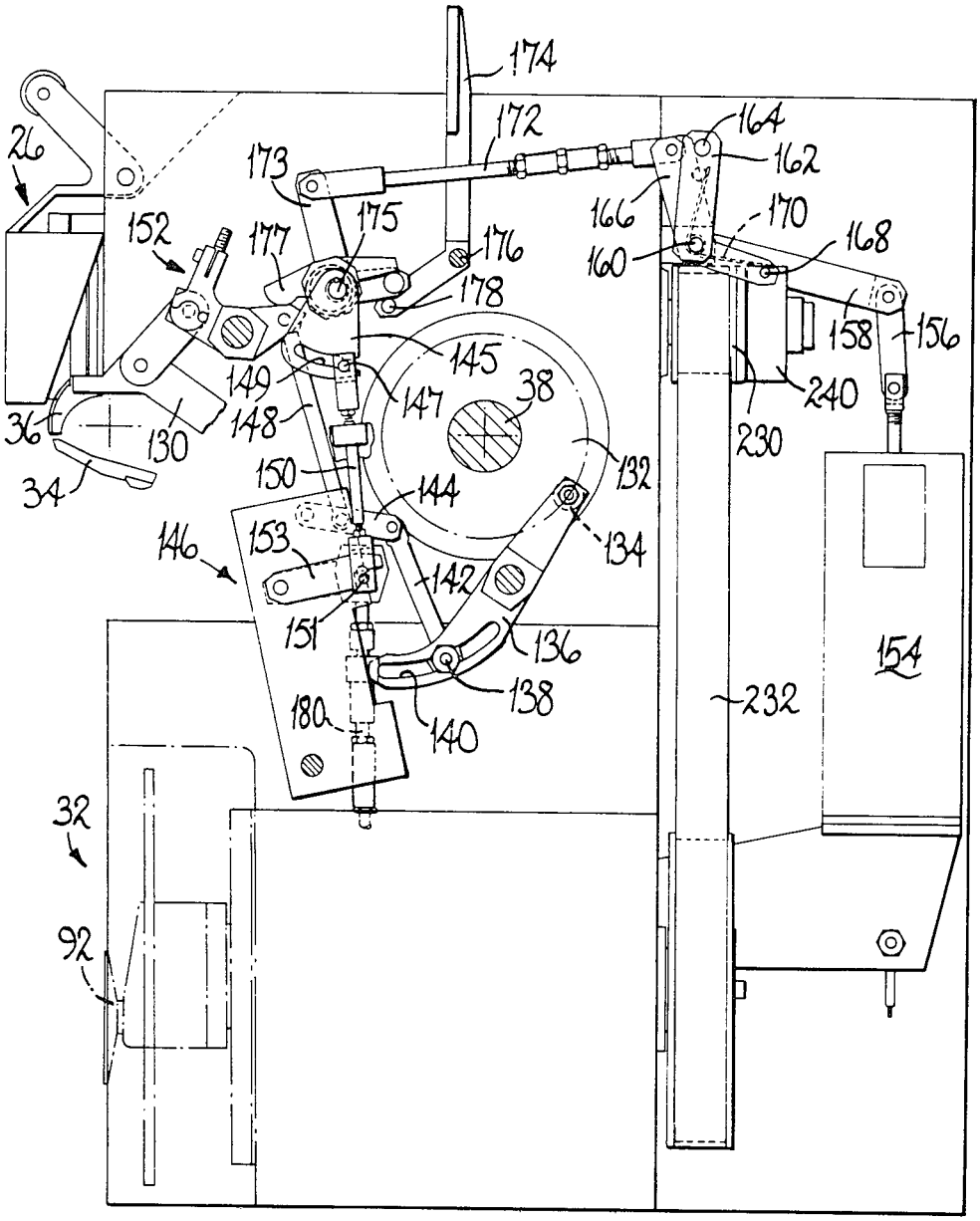
FIG. 2 is a section view of the machine, also taken from the right hand side and showing details of means for controlling the presser foot.

For lifting the presser foot 36 during the return (i.e. non-feeding) stroke of the worktable, furthermore, a further cam 132 is provided on the crank shaft 38. As can be seen in FIG. 2, a cam follower 134 for said cam 132 is carried on a lever 136 pivoted intermediate its length on the machine frame, the other end of the lever being connected by a pin-and-slot connected 138, 140 to a link 142 which is in turn connected, by a further link 144, to a locking arrangement generally designated 146. This arrangement 146 is generally as described in the aforementioned Patent Specification No. 410463, and serves to lock the presser foot 36, when the latter is in clamping engagement with a workpiece carried on the worktable 34, the arrangement being such that the presser foot is thus locked, regardless of the thickness of the work. Further for lifting the presser foot 36, the locking arrangement 146 is connected via a rod 148, which is connected, through a mechanism generally designated 152 and generally similar to the mechanism described in the aforementioned UK Patent Specification, to the lever 130 on which the presser foot 36 is carried.

For raising the presser foot 36 at the end of a stitching cycle, an electrically operated motor, in the form of a so-called linear actuator 154 is mounted on the machine frame, said actuator being connected via a link 156 to a lever 158 which is pivotally mounted on a transverse pin 160 in the machine frame. Also carried by the pin 160 is a lever 162 carrying an abutment pin 164, and further on said pin is a bell crank lever 166, one arm of which is engageable by said pin 164. The other arm of the bell crank lever 166 carries a further pin 168 which is engaged by a torsion spring 170 mounted on the pin 160 and fixed to the lever 162. The torsion spring 170 thus urges the bell crank lever 166 clockwise (viewing FIG. 2). The first-mentioned arm of the bell crank lever 166 is connected, via an adjustable rod 172, to a link 173 which is carried on a transverse pin 175, on which in turn is eccentrically mounted a pusher member 177. The pusher member 177 acts on the linkage 152, adjacent the pivotal connection with the rod 146, the arrangement being such that actuation of the actuator 154 is effective, through the linkage described above, to urge the mechanism 152 clockwise (viewing FIG. 2) and thus to raise the presser foot 36. Thus, actuation of the linear actuator 154, which takes place in response to an "end of cycle" signal being supplied, is effective, against the action of the torsion spring 170, to urge the presser foot 36 into clamping engagement with a workpiece supported by the worktable 34. De-actuation of said actuator 154, on the other hand, enables the spring 170 to return the presser foot to its raised, out-of-the-way position. It is to be noted that, as described in detail in the aforementioned UK Patent Specification No. 410463, rotation of the pin 175 is also effective, through a cam member 145, and more especially through a pin (147) and slot (149) connection, to draw upwardly a rod 150 which carries a pin 151 co-operative with a lever 153 which is pivotally mounted in the locking arrangement 146 and serves, upon such pivotal movement being effected, to unlock the locking arrangement 146.

For emergency purposes, furthermore, in addition to the actuator 154, a manually operable bell crank lever 174 is provided, pivoted on a pin 176 carried in the machine frame, a lower arm of said lever carrying an abutment pin 178 engageable with the pusher member 177 of the presser foot actuating mechanism. Thus, the machine operator can, at any stage in the operating cycle of the machine, lift the presser foot 36 to its out-of-the-way position by actuation of the lever 174.

The locking of the locking arrangement 146 is achieved via a rod 180 which is operatively connected at its upper end, to the lever 153 and, at its lower end, by a linkage generally designated 182, to a lever 184 carrying a cam follower 186 operatively engaged in a cam 188 mounted on a further cam shaft 190 (see FIG. 1) of the machine. As described in detail in the aforementioned UK Patent Specification No. 410463, the locking arrangement is unlocked after the presser foot 36 is raised by means of the cam 132 and prior to its being again lowered into engagement with the work.

The further cam shaft 190 is driven, through meshing gears 192 (one only shown in FIG. 1) carried on the cam shaft 190 and the shaft 88 (by which the so-called take-up arrangement 32 is driven). Thus, the cam shaft 190 effects a single rotation for each operating cycle of the machine and, furthermore, is driven synchronously with the crank shaft 38. Also mounted on the cam shaft 190, at one end thereof, is a crank (not shown) connected by a linkage with a rock shaft (also not shown) associated with the thread take-up arrangement 32 for modifying the action of the take-up roll 92, for purposes described in detail in the aforementioned UK Patent Specification No. 410463.

For controlling the supply of running thread T2 to the take-up arrangement 32, the thread, after leaving a heated wax pot (if waxing is required, is entrained over a lower roll 194 (see FIG. 5), over a fixed intermediate roll 196 and then over an upper roll 198, thereafter passing on to the take-up roll 92 of the thread take-up arrangement 32. As described in detail in the aforementioned UK Patent Specification No. 410463, the lower and upper rolls 194, 198 each have associated therewith a thread clamping device for clamping the thread; thus, with sufficient running thread T2 supplied for the next stitch to be made, the lower thread lock is applied while the upper thread lock is released, while, after a stitch has been made, the upper lock is applied while the lower lock is released for drawing off a further quantity of thread from the supply for the next stitch to be made.

Figure 6:
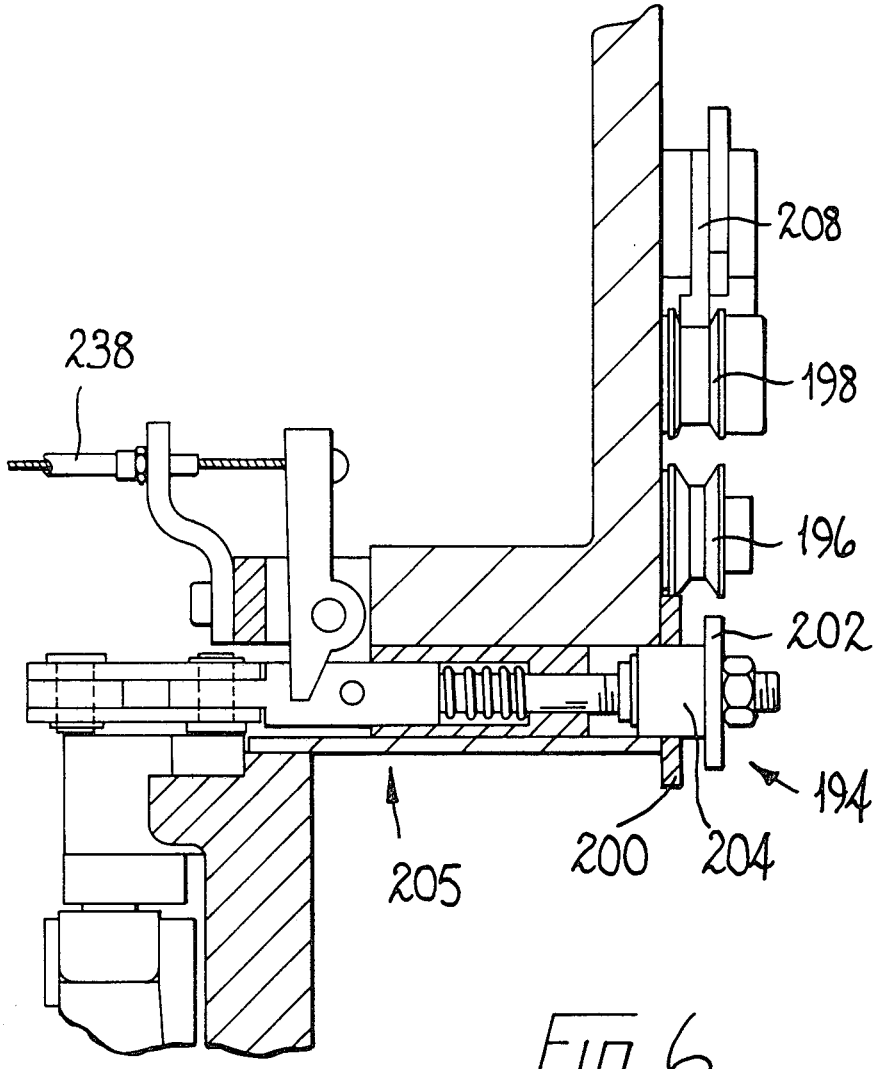
FIG. 6 is a fragmentary view in plan showing further details of the integer shown in FIG. 5.

The lower roll and lock (FIGS. 5 and 6) are constituted by two discs 200, 202 between which the thread T2 is entrained. One (200) of the discs which is fixed in relation to the machine frame and the other (202) is mounted on a spindle 204 slideable in the machine frame under the action of a cam-operated linkage generally designated 205, a cam 206 being carried on the shaft 88 of the take-up arrangement 32 for operating said linkage.

The upper lock comprises a shoe 208 which is shaped to clamp the thread T2 against the surface of the upper roll 198. Again, this shoe 208 is actuated by a cam-operated linkage generally designated 210, a cam 212 being mounted on the cam shaft 190 for operating this linkage.

For measuring the amount of thread to be supplied to the take-up arrangement 32 for each stitch to be made, a thread measuring roll 214 is arranged between the intermediate and upper rolls 196, 198. The thread measuring roll 214 is carried on an arm 216 which is pivotally mounted for rotation about an axis extending parallel with the shaft 88. As fully described in UK Patent Specification No. 410463, the amount of movement of the thread measuring roll, in measuring thread for the next stitch to be made, is controlled by means of a cam 218 mounted on the shaft 88, but is modified according to the thickness of the work being operated upon, as sensed by the presser foot 36 when the latter is brought into clamping engagement with the work. This modification is achieved through a linkage by which the rod 180 is connected to the arm 214.

In the operation of the machine, each stitch is "set" in the work by the operation of the take-up roll 92; a stitch is "set" by drawing the stitch formed by the bobbin thread T1 and running thread T2 into the body of the work, customarily at approximately one third of the thickness work from the "needle" side thereof. In practice, the setting of each stitch takes place at the beginning of the formation of the next following stitch, so that at the end of a stitching cycle, the final stitch is not correctly set. The machine in accordance with the present invention therefore also comprises stitch setting means for setting this final stitch, said means comprising a roller 220 which is mounted on a cranked arm 222 pivoted, intermediate its length, on the machine frame, said arm 222 being pivotally connected at its other end to an output 224 of a solenoid 226, also mounted on the machine frame. The solenoid is actuated in response to an "end of cycle" signal and causes the roller 220 to engage the thread, between the lower and intermediate rolls 194, 196 and to apply a tensioning draft to the running thread T2, which is at this time locked at the lower thread lock and roll 194. The effect of this action is to draw the running thread T2 downwardly, thereby drawing the lockstitch into the body of the work.

As already mentioned above, the shuttle 26 is generally similar in construction and operation to the shuttle described in UK Patent Specification No. 806265. In the machine in accordance with the present invention, however, the shuttle drive comprises a straight shaft 228 extending fore-and-aft of the machine, the rear of the shaft carrying a timing pulley 230 which is connected by a timing belt 232 to a further timing pulley 234 carried on the rearward end of the cam shaft 190. The ratio between the pulleys 234, 230 is 3:1 so that the shuttle effects three rotations for each single rotation of the shaft 190; it will of course be appreciated that only one of each three rotations of the shuttle is operable in the formation of a stitch, the 3:1 ratio being merely provided to give the required speed of rotation of the shuttle during stitch formation. In order to protect the shaft 228 in the event of disruption of the machine operation, a break-away clutch (not shown) is provided at the rearward end of the shaft.

The machine in accordance with the invention also comprises electronic control means by which the actuator 150, solenoid 226 and other elements of the machine operation can be controlled. The control means includes a shaft encoder 236 which is mounted at a rearward end of the shaft 88, said encoder being effective to ensure that, when the machine comes to rest, the needle 20 and awl 24 are clear of the work. To this end, when an "end of cycle" signal is supplied, by the operator releasing a treadle (not shown) also forming part of the control means, initially a brake (not shown) is applied to the output drive shaft of the motor, whereby the speed of rotation thereof, and thus of the various shafts 38, 88, 190 and 228 is reduced to "slow" speed (in casu about 100 rpm), whereafter the brake is released until the shaft encoder senses the stop position, the brake then being fully applied. Sensing the stop position is also effective to cause the stitch setting solenoid 226 to be actuated, thereby ensuring that the final stitch is properly set, the shoe remaining clamped by the presser foot 36 at this time. Upon signalling the actuation of the solenoid 226, furthermore, a timer (not shown) of the control means is energized, and this timer, upon timing out, causes the timer actuator 154 to be energized, whereby the presser foot lock 146 is released and the presser foot 36 is raised. At the same time, the actuator, through a Bowden cable connection 238 with the lower thread lock linkage 205, causes the lower thread lock to be released, so that the shoe can be removed from the worktable 34. The operator can then sever the leading end of the running thread T2.

The control means is also effective to control the temperature of the shuttle, which is of course maintained at elevated temperature for heating the shuttle thread T1. Similarly, where a wax pot is provided for the running thread T2, the temperature of this is similarly controlled.

Attention is drawn to our co-pending patent application Ser. No. 648,657 filed on even date with this application.

We claim:

1. A lockstitch sewing machine comprising stitch forming instrumentalities, including a reciprocating hooked needle, on to the hook of which a loop of (needle) thread can be looped, when the needle has penetrated a workpiece and while it is projecting therethrough, and also a rotatable shuttle, by which the loop of thread is engaged, after retraction of the needle, and a lockstitch is formed using said loop and a further (bobbin) thread, thread measuring means for supplying a measured quantity of needle thread for each stitch formation, means, arranged "upstream" of the stitch forming instrumentalities, for clamping the thread after the measured quantity has been supplied as aforesaid, and means, arranged between the thread clamping means and the stitch forming instrumentalities, and including a thread take-up arrangement, by which said measured quantity of thread is controlled during stitch formation and by which also a formed lockstitch can be drawn into the body of the workpiece, such drawing of the formed stitch taking place while the thread remains clamped by the thread clamping aeans, but after the start of the formation of the next following stitch, wherein, for the final stitch formed in a machine stitching cycle, stitch setting means is provided which is arranged "downstream" of the thread clamping means and which, in response to an "end of cycle" signal, is caused to pull on the thread to draw the formed stitch into the body of the workpiece, prior to the release of the thread by the thread clamping means, the latter thereafter being operated to release the thread.

2. A machine according to claim 1 wherein a timer is provided which is actuated when the stitch setting means is operated and, on timing out, causes the thread clamping means to be operated to release the thread.

3. A machine according to claim 2 wherein the stitch setting means is operated by an electrically operated motor.

4. A machine according to claim 3 wherein a worktable and a presser foot are arranged at an operating locality of the machine for clamping therebetween a workpiece to be stitched and for feeding such workpiece step-by-step past the stitch forming instrumentalities, the presser foot being moved out of such clamping engagement, in response to the "end of cycle" signal, under the control of an electrically operated linear motor, the arrangement being such that said motor is caused to operate to move the presser foot after the stitch setting means has been operated as aforesaid.

5. A machine according to claim 4 wherein the linear motor is operated as aforesaid on timing out of the timer and serves also to cause the thread clamping means to be operated to release the thread.

6. A machine according to claim 5 wherein the linear motor is connected to the presser foot through a linkage arrangement and is directly connected to the thread clamping means through a Bowden cable arrangement.

7. A machine according to claim 6 wherein the operation of the stitch forming instrumentalities is controlled by a shaft which is driven by a braked motor and on which also is carried a shaft encoder, the arrangement being such that, in response to the "end of cycle" signal, the motor is braked to a slow speed whereafter it continues rotating until a "stop" position, in which the stitch forming instrumentalities are clear of the workpiece, is sensed by the encoder, whereupon the brake is re-applied to stop the rotation thereof, the encoder also signalling the operation of the stitch setting means to take place as aforesaid, when such stop position is sensed.

8. A machine according to claim 7 wherein the timer is actuated by a signal from the encoder.

9. A machine according to claim 8 wherein further thread clamping means is arranged "downstream" of the thread measuring means, the arrangement being such that said further means is operated to clamp the needle thread while a measured quantity is drawn from a supply thereof by the thread measuring means, and wherein the first-mentioned thread clamping means is arranged "upstream" of the further thread clamping means, for clamping the thread after the thread measuring means has operated as aforesaid, and further wherein the stitch setting means is disposed intermediate the two thread clamping means and is operated while the first-mentioned means is in thread clamping condition, but while the thread is unclamped by said further means.

* * * * *